US009093797B2

(12) United States Patent
Zhao et al.

(10) Patent No.: US 9,093,797 B2
(45) Date of Patent: Jul. 28, 2015

(54) CONNECTOR HAVING SOLDERING LEGS ARRAY AND METHOD FOR MAKING THE SAME

(71) Applicant: HON HAI PRECISION INDUSTRY CO., LTD., New Taipei (TW)

(72) Inventors: Jun Zhao, Shenzhen (CN); Jing-Jie Guo, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/142,943

(22) Filed: Dec. 30, 2013

(65) Prior Publication Data

US 2014/0187105 A1 Jul. 3, 2014

(30) Foreign Application Priority Data

Dec. 30, 2012 (CN) ..... 2012 1 0586141

(51) Int. Cl.
*H01R 13/40* (2006.01)
*H01R 12/70* (2011.01)
*H01R 13/6593* (2011.01)

(52) U.S. Cl.
CPC ..... *H01R 12/707* (2013.01); *H01R 13/6593* (2013.01); *Y10T 29/49204* (2015.01)

(58) Field of Classification Search
CPC .... H01R 13/516; H01R 12/707; H01R 13/46; H01R 13/6581; H01R 13/6594; H01R 12/716; H01R 12/57; H01R 13/6593; Y10T 29/49204
USPC ..... 439/733.1, 626
See application file for complete search history.

(56) References Cited

U.S. PATENT DOCUMENTS

| | | | | |
|---|---|---|---|---|
| 7,922,535 | B1 * | 4/2011 | Jiang et al. | 439/607.35 |
| 8,011,956 | B1 * | 9/2011 | Yang et al. | 439/589 |
| 8,038,474 | B2 * | 10/2011 | Ju | 439/607.01 |
| 8,282,417 | B2 * | 10/2012 | Xiao | 439/607.36 |
| 8,292,662 | B2 * | 10/2012 | Yang et al. | 439/587 |
| 8,292,674 | B1 * | 10/2012 | Yang et al. | 439/660 |
| 2008/0182457 | A1 * | 7/2008 | Wu | 439/626 |
| 2012/0071026 | A1 | 3/2012 | Yang et al. | |
| 2014/0120775 | A1 * | 5/2014 | Yen et al. | 439/626 |

FOREIGN PATENT DOCUMENTS

| | | |
|---|---|---|
| TW | M322654 | 11/2007 |
| TW | M383224 | 6/2010 |
| TW | M432980 | 7/2012 |

* cited by examiner

*Primary Examiner* — Jean F Duverne
(74) *Attorney, Agent, or Firm* — Wei Te Chung; Ming Chieh Chang

(57) ABSTRACT

An electrical connector comprising an insulative housing, a plurality of terminals retained in the insulative housing, and a metal package enclosing the insulative housing, said metal package comprising a first metallic shell and a second metallic shell covering the first metallic shell, said first metallic shell having an upper wall, a bottom wall and a pair of side walls, said second metallic shell having a top board, a floor board and a pair of side boards. Said second metallic shell is formed with a plurality of first soldering legs extending downwardly from a back-end of the top board, second soldering legs extending outwardly from the side boards, and said first metallic shell is formed with a plurality of fixed legs extending outwardly from a rear-end of the side walls; wherein said fixed legs are located between the first soldering legs and the second soldering legs along a front-to-back direction.

13 Claims, 9 Drawing Sheets

CONNECTOR HAVING SOLDERING LEGS ARRAY AND METHOD FOR MAKING THE SAME

BACKGROUND OF THE INVENTION

1. Field of the Invention

The present invention relates generally to an electrical connector, and more particularly to an electrical connector having special soldering legs array.

2. Description of Related Arts

Universal Serial Bus (USB) interfaces are widely used in various electronic devices. In recent years, a micro USB interface is introduced to meet miniaturization requirement of electronic devices. Taiwan Utility Model No. M4320980 discloses an electrical connector comprising an insulative housing, a plurality of terminals, an inner shell enclosing the insulative housing and an outer shell enclosing the inner shell. The inner shell has a top wall and the outer shell has a pair of side walls. The inner shell and the outer shell are formed with a plurality of soldering legs sheilding the insulative housing. Generally, the inner shell and the outer shell firstly are soldered together, then enclosing the insulative housing and forming the soldering legs at last. When the inner shell and the outer shell are assembled, it is difficult to bend the soldering legs downwardly from the top wall at an accurate angle. Taiwan Utility Model No. M322654 discloses an electrical connector comprising a metal shell. The metal shell has an upper wall and a pair of side walls. The electrical connector further has a plurality of first soldering legs bent downwardly from each side wall and a pair of second soldering legs bent downwardly from the upper wall. The connector has only one shell forming the first and second soldering legs. The sheet of the shell is so thin that the first and second soldering legs are easy to be distorted. Taiwan Utility Model No. M389967 discloses an electrical connector comprising an upper shell having an upper board and a bottom shell. The upper shell has a pair of soldering arms bent downwardly from the upper board. It is hard to fix the bottom shell since no soldering arms are provided on the bottom shell.

An electrical connector having a pair of shells firmly fixed to each other and easily assembled is desired.

SUMMARY OF THE INVENTION

Accordingly, an object of the present invention is to provide an electrical connector having a pair of shells that can be firmly fixed to each other and easily assembled.

To achieve the above object, an electrical connector comprising: an insulative housing having a base portion; a plurality of terminals retained in the insulative housing; and a metal package enclosing the insulative housing, said metal package comprising a first metallic shell and a second metallic shell covering the first metallic shell, said first metallic shell having an upper wall, a bottom wall and a pair of side walls connecting the upper wall and the bottom wall, said second metallic shell having a top board, a floor board and a pair of side boards connecting the top board and the floor board; wherein said second metallic shell is formed with a plurality of first soldering legs extending downwardly from a back-end of the top board, second soldering legs extending outwardly from the side boards, and said first metallic shell is formed with a plurality of fixed legs extending outwardly from a rear-end of the side walls; wherein said fixed legs are located between the first soldering legs and the second soldering legs along a front-to-back direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
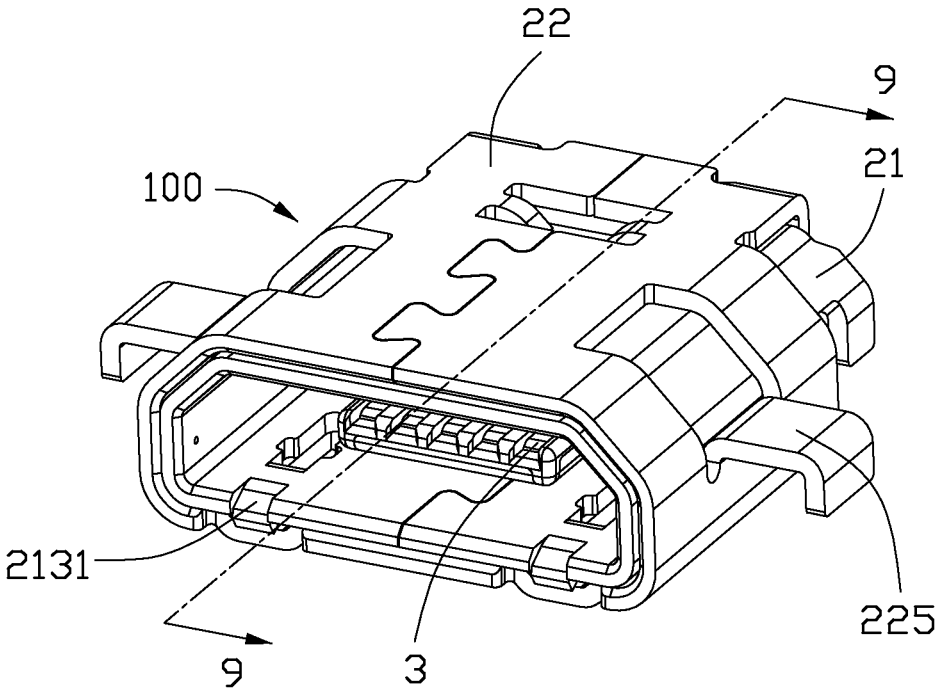
FIG. 1 is a perspective, assembled view of an electrical connector.
Figure 2:
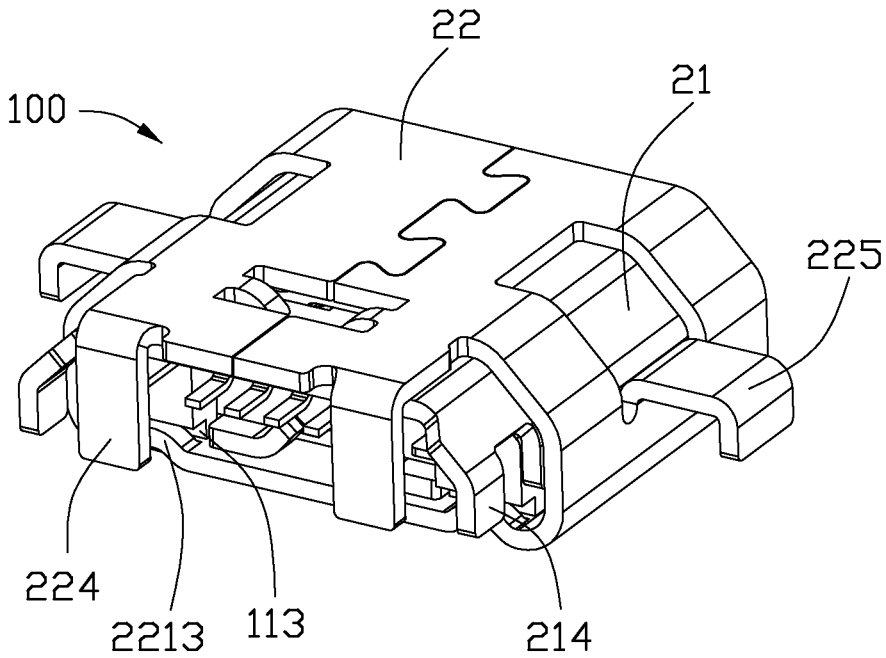
FIG. 2 is a perspective, assembled view of the electrical connector, taken from a different view with respect to FIG. 1.
Figure 3:
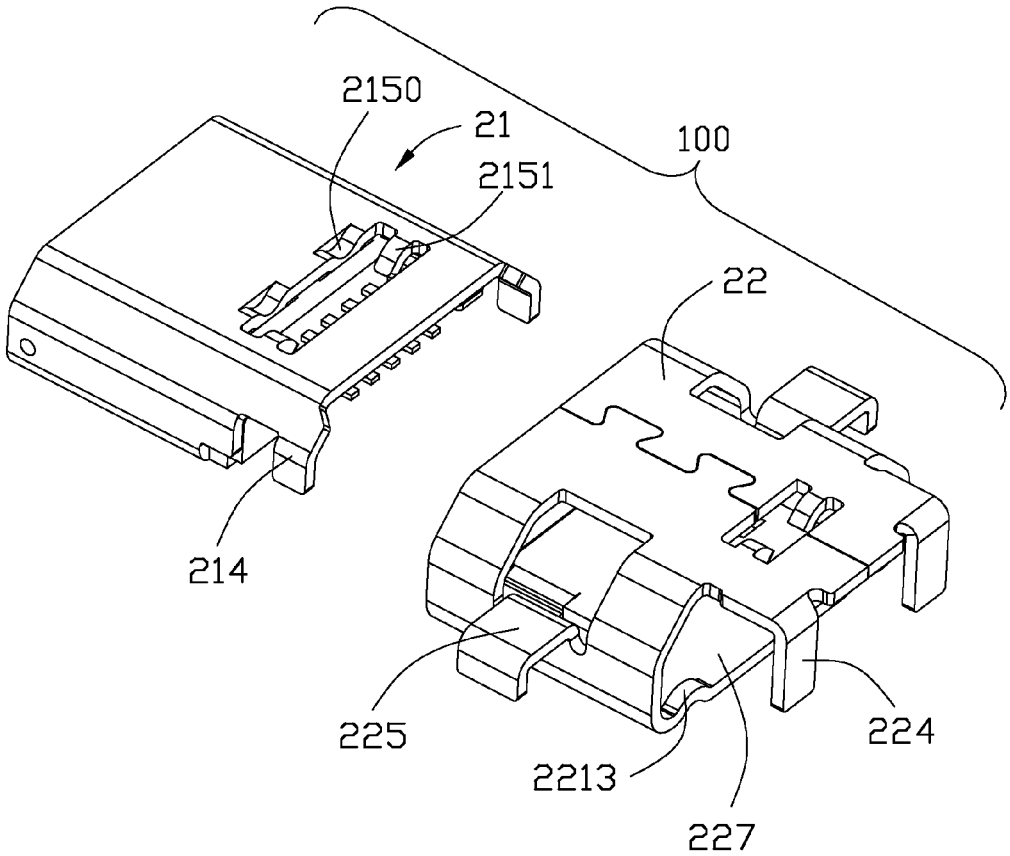
FIG. 3 is a perspective, partly exploded view of the electrical connector.
Figure 4:
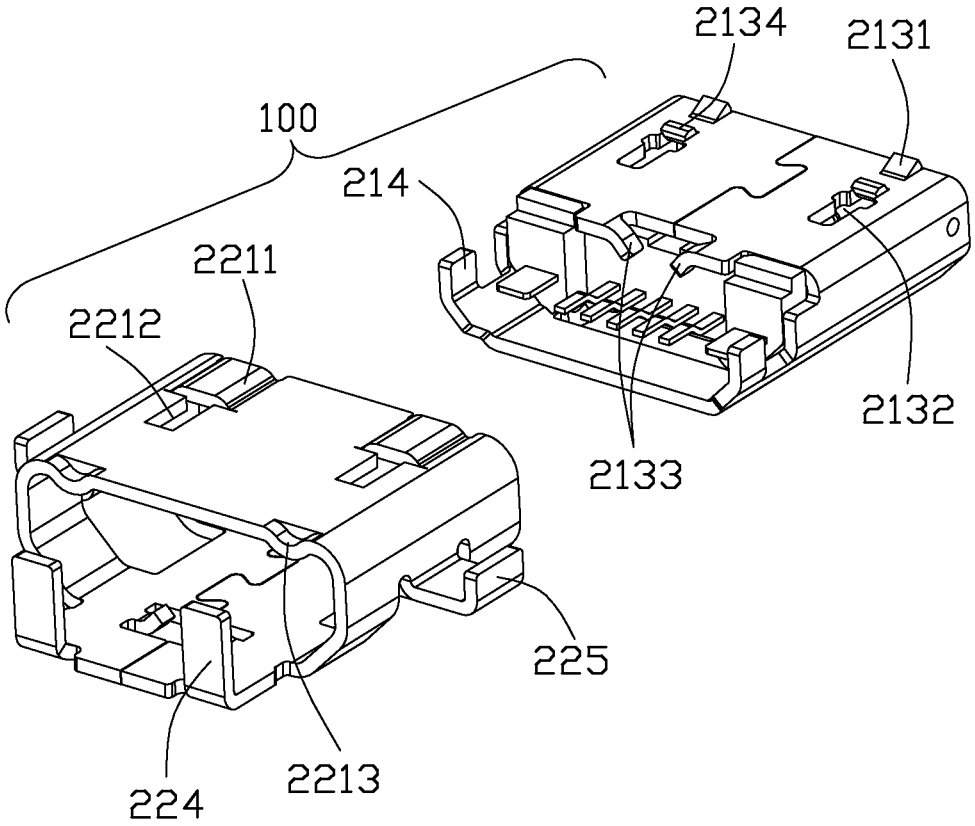
FIG. 4 is a perspective, partly assembled view of the electrical connector, taken from a different view with respect to FIG. 3.
Figure 5:
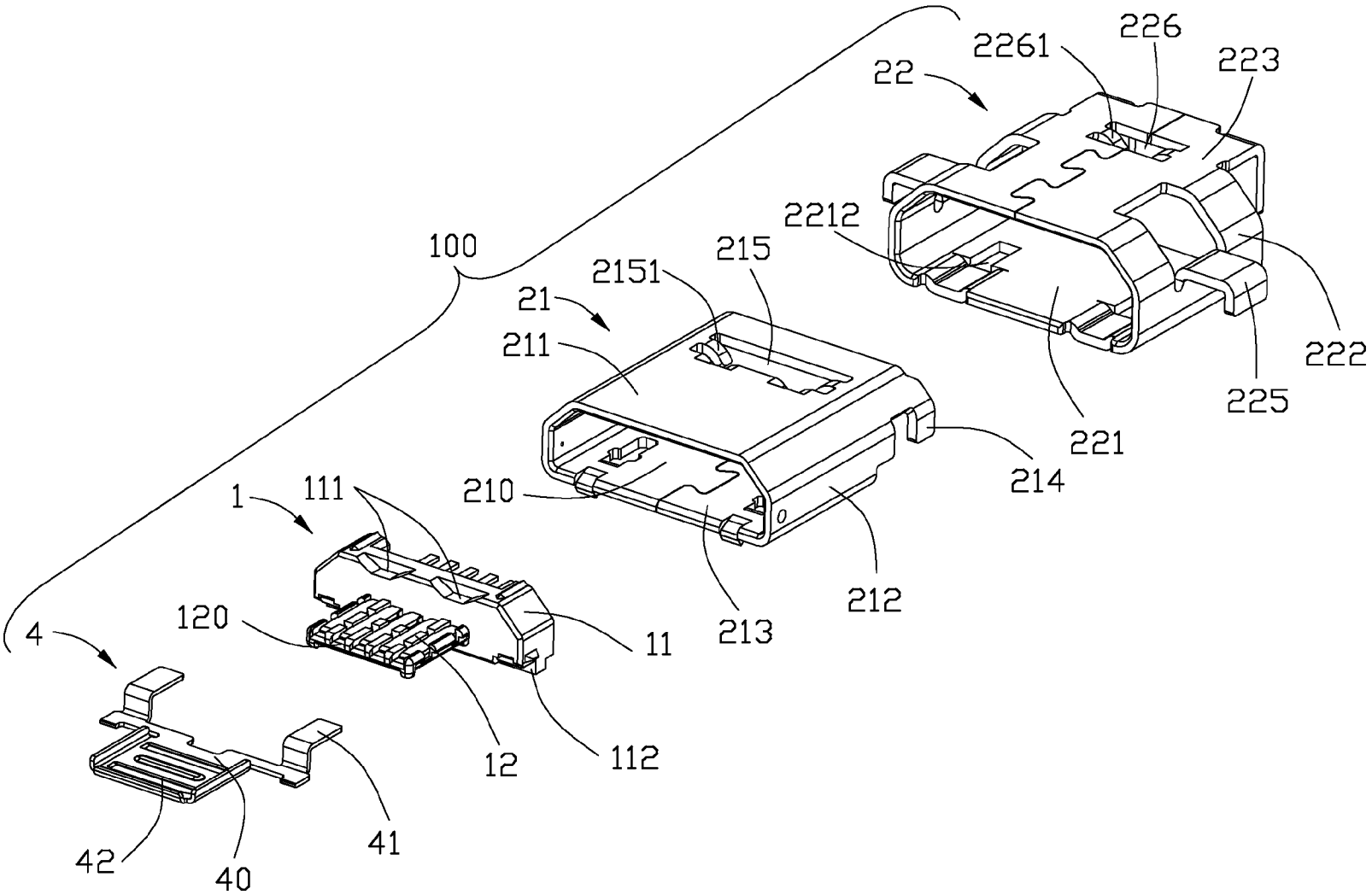
FIG. 5 is a perspective, exploded view of the electrical connector.
Figure 6:
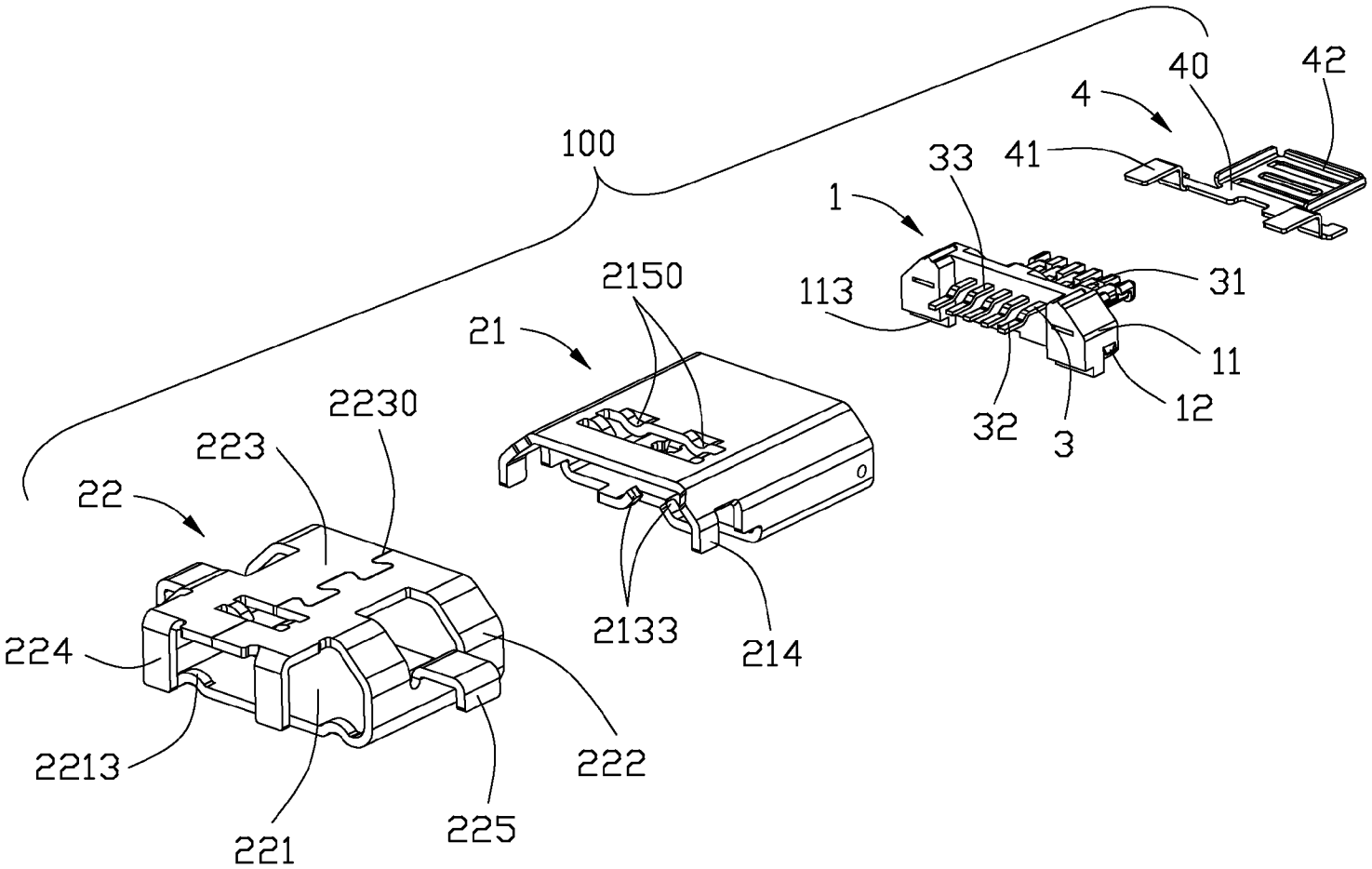
FIG. 6 is a perspective, exploded view of the electrical connector, taken from a different view with respect to FIG. 5.
Figure 7:
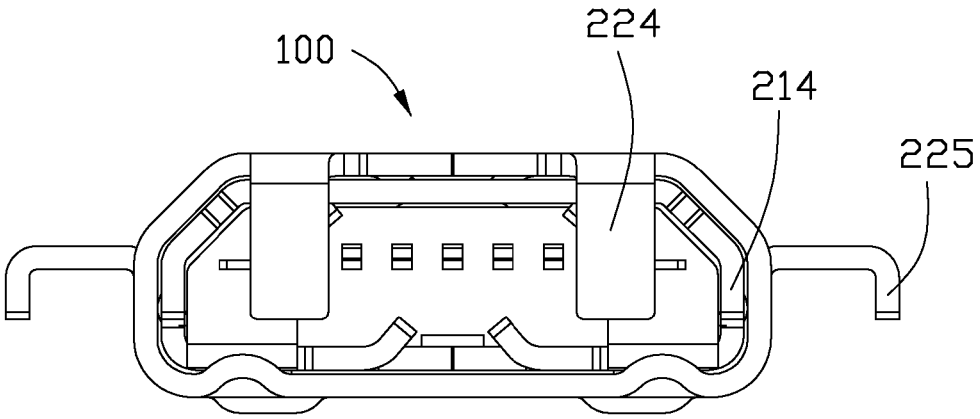
FIG. 7 is a rear elevational view of the electrical connector.
Figure 8:
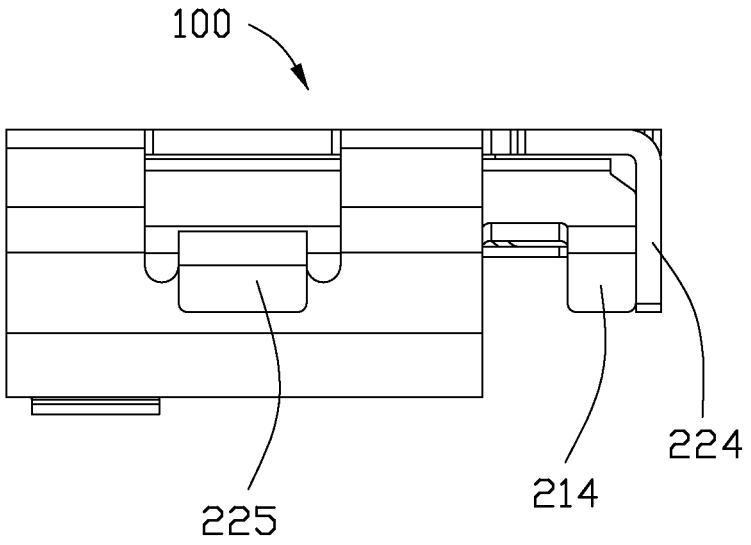
FIG. 8 is a right side view of the electrical connector.
Figure 9:
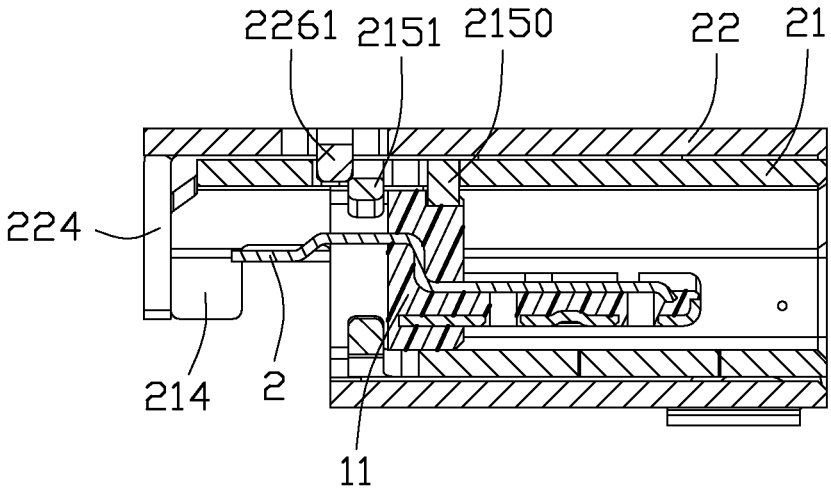
FIG. 9 is a cross sectional view taken along a line 9-9 in FIG. 1.

Referring to FIGS. 1 to 9, an electrical connector 100 of the present invention comprises an insulative housing 1, a metal package 2 enclosing the insulative housing 1 and including a first metallic shell 21 and a second metallic shell 22, a plurality of terminals 3 received in the insulative housing 1 and a metal plate 4 retained in the insulative housing 1. The electrical connector 100 defines a front-to-back direction and a transverse direction perpendicular to the front-to-back direction in a horizontal plane.

Referring to FIGS. 3 to 6, the insulative housing 1 comprises a base portion 11 and a tongue portion 12 extending from the base portion 11. The base portion 11 is formed with two first recesses 111, two second recesses 112 and a pair of slots 113. The first recesses 111 are located at a top of the base portion 11 and the second recesses 112 are located at a bottom of the base portion 11. The slots 113 are located at the bottom of the base portion 11 and behind the second recesses 112. The tongue portion 12 has a plurality of receiving grooves 120.

Each terminal 3 comprises a soldering portion 32 for soldering onto a printed circuit board, a fixing portion 22 received in the receiving grooves 120 and a contacting portion 31 extending from the fixing portion 32.

The metal plate 4 comprises a pair of positioning portions 41, a main portion 42 attached to the tongue portion 12, a pair of bent portions 40 extending rearwardly from the main portion 42. The positioning portions 41 are formed at two distal ends of the bent portions 42 and exposed on the insulative housing 1.

Referring to FIGS. 4 to 9, the first metallic shell 21 comprises an upper wall 211, a bottom wall 213 and a pair of side walls 212 connecting the upper wall 211 and the bottom wall 213. The upper wall 211, the bottom wall 213 together with the side walls 212 define a receiving room 210 to receive the insulative housing 1. The first metallic shell 21 defines a first punching hole 215 located at a back-end of the upper wall 211 and a pair of protrusions 2150 disposed in front of the first punching hole 215 and engaged with the first recesses 111.

The upper wall 211 has a pair of first clamping arms 2151 extending downwardly from a side-edge of the first punching hole 215 and resisting against a front-end of the base portion 11. The first metallic shell 4 further has a pair of fixed legs 214 extending downwardly from a rear-end of the side walls 212. The bottom wall 213 has two guilding protrusions 2131, two contacting holes 2132 behind the guilding protrusions 2131 and two dimples 2134 in front of the guilding protrusions 2131 for matching with the mating connector. The first metallic shell 21 further has a pair of resisting arms 2133 extending downwardly from the bottom wall 213.

Referring to FIGS. 1 to 9, the second metallic shell 22 covering the first metallic shell 21 comprises a top board 223, a floor board 221 and a pair of side boards 222 connecting the top board 223 and the floor board 221. The floor board 221 has two blocks or bulged portions 2211 covering the dimples 2134 and resisting against the guilding protrusions 2131 after assembling. The resisting holes 2212 are defined behind the two blocks 2211. The floor board 221 further has a pair of second projections 2213 engaging with the slots 113. The top board 223 is formed with a second punching hole 226 and a pair of second clamping arms 2261 extending from a side-edge of the second punching hole 226. The second clamping arms 2261 resist against a back-edge of the first punching hole 215. The second metallic shell 22 further has a pair of first soldering legs 224 extending downwardly from the top board 223 and a pair of second soldering legs 225 extending downwardly from the side board 222.

In assembling of the electrical connector 100, in a first step, providing the insulative housing 1, the plurality of terminals 3 insert-molded with the insulative housing 1, and the metal plate 4 attached to the insulative housing 1. In a second step, providing a metalsheet punched respectively into the first metallic shell 21 and a second metallic shell 22. The first metallic shell 21 is punched with a pair of clamping arms 2151 bent downwardly from the back-end of the upper wall 211. The second metallic shell 22 is punched with a pair of first soldering legs 224 bent downwardly from a rear-end of the side boards 222 and a pair of second soldering legs 225 bent laterally then downwardly from the side boards 222. In a third step, mounting the first metallic shell 21 onto the insulative housing 1 forwardly. In a fourth step, mounting the second metallic shell 22 onto the first metallic shell 21 forwardly.

The metal package 2 defines a centerline along the front-to-back direction and the first metallic shell 21 together with the second metallic shell 22 is symmetrical with respect to the centerline. The fixed legs 214 are located between the first soldering legs 224 and the second soldering legs 225 along both the front-to-back direction and the transverse direction.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing having a base portion;

a plurality of terminals retained in the insulative housing; and a metal package enclosing the insulative housing, said metal package comprising a first metallic shell and a second metallic shell covering the first metallic shell, said first metallic shell having an upper wall, a bottom wall and a pair of side walls connecting the upper wall and the bottom wall, said second metallic shell having a top board, a floor board and a pair of side boards connecting the top board and the floor board;

wherein said second metallic shell is formed with a plurality of first soldering legs extending downwardly from a back-end of the top board, second soldering legs extending outwardly from the side boards, and said first metallic shell is formed with a plurality of fixed legs extending outwardly from a rear-end of the side walls;

wherein said fixed legs are located between the first soldering legs and the second soldering legs along a front-to-back direction; wherein the first metallic shell defines a first punching hole located at the back-end of the upper wall and a pair of first projections disposed in front of the first punching hole, and said base portion has a pair of first recesses engaged with the first projections; wherein said upper wall is formed with a pair of first clamping arms extending downwardly from the first punching hole and said first clamping arms resist against a front-end of the base portion.

2. The electrical connector as claimed in claim 1, wherein said metal package defines a centerline along the front-to-back direction and the first metallic shell together with the second metallic shell is symmetrical with respect to the centerline.

3. The electrical connector as claimed in claim 2, wherein said metal package defines a transverse direction perpendicular to the front-to-back direction on a horizontal plane and said fixed legs are located between the first soldering legs and the second soldering legs along the transverse direction.

4. The electrical connector as claimed in claim 1, wherein said second metallic shell defines a second punching hole located at the back-end of the top board and a pair of second clamping arms disposed in the second punching hole and resisted against a rear contour of the first punching hole.

5. A method of assembling an electrical connector comprising:

a first step: providing an insulative housing, a plurality of terminals insert-molded with the insulative housing, and a metal plate attached to said insulative housing;

a second step: providing a metalsheet, said metalsheet punched respectively into a first metallic shell and a second metallic shell, the first metallic shell punched with a pair of fixed legs bent downwardly from the back-end of the upper wall, the second metallic shell punched with a pair of first soldering legs bent downwardly from a rear-end of the side boards and a pair of second soldering legs bent laterally then downwardly from the side boards;

a third step: mounting the first metallic shell onto the insulative housing forwardly; and a fourth step: mounting the second metallic shell onto the first metallic shell forwardly.

6. The method of assembling an electrical connector as claimed in claim 5, wherein said fixed legs are located between the first soldering legs and the second soldering legs along both a front-to-back direction and the transverse direction perpendicular to the front-to-back direction.

7. An electrical connector comprising:

an insulative housing defining a forwardly extending mating tongue in a front-to-back direction;

a plurality of contacts disposed in the housing with contacting sections exposed upon the mating tongue in a vertical direction perpendicular to said front-to-back direction;

a metal plate integrally formed with the mating tongue; and a metal package enclosing said insulative housing; wherein the contacts define horizontal soldering tails, the metal plate defines at least one horizontal positioning portion, and the metal package defines at least one horizontal soldering leg, all said horizontal soldering tails, horizontal positioning portion and said horizontal soldering leg are locate at a same plane around a middle level of the whole connector in the vertical direction for mounting to a printed circuit board; wherein the housing and the inner shell, which are firstly assembled with each other as a subassembly, are configured to only allow said housing to be forwardly assembled into the inner shell in said front-to-back direction, and said inner shell defines at least a clamping arm deflected to abut against a rearward face of the housing for securing the housing in position after the housing is forwardly assembled into the inner shell; wherein said subassembly is successively assembled to the outer shell, and said subassembly and said outer shell are configured to only allow said subassembly to be rearwardly assembled into the outer shell in said front-to-back direction, and the outer shell defines at least another clamping arm deflected to rearwardly confront a forward face of the inner shell for securing the subassembly in position after said subassembly is rearwardly assembled into the outer shell; wherein said clamping arm of the inner shell and said clamping arm of the outer shell are adjacent to each other.

8. The electrical connector as claimed in claim 7, wherein said metal package includes a metallic inner shell enclosed in a metallic outer shell, and said horizontal soldering leg is formed on the outer shell.

9. The electrical connector as claimed in claim 8, wherein said horizontal soldering leg is further equipped with a vertical extending tip.

10. The electrical connector as claimed in claim 7, wherein the inner shell defines at least an outwardly extending dimple and an outward extending guiding protrusion in said front-to-back direction, and the outer shell defines an outwardly extending bulged portion correspondingly to receive said dimple and said guiding portion therein.

11. The electrical connector as claimed in claim 10, wherein said inner shell further defines a contacting hole behind the dimple in said front-to-back direction, and said outer shell further defines a resisting hole in alignment with the contacting hole in the vertical direction.

12. The electrical connector as claimed in claim 7, wherein the outer shell further defines a rear soldering leg, and said inner shell further defines a fixed leg located between the horizontal soldering portion and the side solder leg of said outer shell in a transverse direction perpendicular to both said front-to-back direction and said vertical direction.

13. The electrical connector as claimed in claim 7, wherein said housing defines at least forward recess to receive at least a protrusion of the inner shell to prevent forward movement of the housing relative to the inner shell, and further defines a rearward slot to receive at least a projection of the outer shell to prevent rearward movement of the housing relative to the outer shell.

* * * * *